United States Patent [19]

Mailliet

[11] 4,418,894

[45] Dec. 6, 1983

[54] FURNACE TAPHOLE DRILLING APPARATUS AND METHOD

[75] Inventor: Pierre Mailliet, Howald, Luxembourg

[73] Assignee: Paul Wurth S.A., Luxembourg, Luxembourg

[21] Appl. No.: 317,767

[22] Filed: Nov. 3, 1981

[30] Foreign Application Priority Data

Nov. 17, 1980 [LU] Luxembourg ..... 82943

[51] Int. Cl.[3] ..... C21B 7/12

[52] U.S. Cl. ..... 266/271; 266/45

[58] Field of Search ..... 266/271, 272, 273, 45; 81/451; 175/408; 408/75, 84, 207, 208, 209, 238 R, 241 G, 237, 704, 705; D7/68; 33/185 R; 248/251

[56] References Cited

U.S. PATENT DOCUMENTS

| | | | |
|---|---|---|---|
| 1,495,906 | 5/1924 | Kendall | 81/451 |
| 1,817,680 | 8/1931 | Pratt | 428/666 X |
| 2,528,358 | 10/1950 | Grass | 248/251 |
| 2,657,894 | 11/1953 | Sklenar | 248/251 X |
| 2,908,471 | 10/1959 | Hollansworth | 248/251 X |
| 3,199,380 | 8/1965 | Threlkeld | 408/84 X |
| 3,245,437 | 4/1966 | Holz | D7/68 X |
| 4,097,033 | 6/1978 | Mailliet | 266/271 |
| 4,201,373 | 5/1980 | Ulveling et al. | 266/271 |
| 4,311,071 | 1/1982 | Bassell | 81/451 X |

*Primary Examiner*—Brian E. Hearn
*Assistant Examiner*—David A. Hey
*Attorney, Agent, or Firm*—David S. Fishman

[57] ABSTRACT

A drill rod, left in place in the plug of a taphole of a shaft furnace, is withdrawn by apparatus including a conventional percussive type taphole drill which is movable along a support bar. The support bar is provided, at the end which most closely approaches the furnace, with a guide and support head which engages and supports the drill rod as it is being withdrawn subsequent to loosening from the plugging material in the taphole.

6 Claims, 9 Drawing Figures

FIG.5
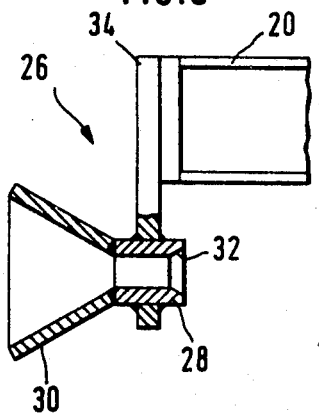
FIG.6
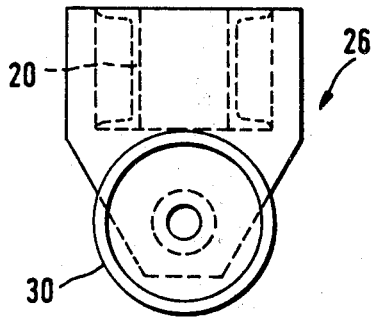
FIG.7
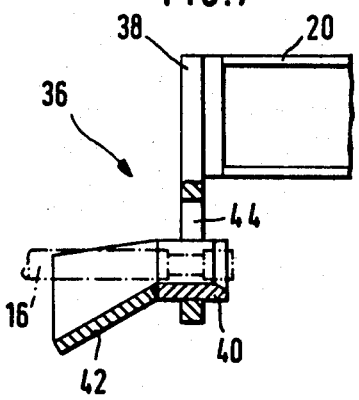
FIG.8
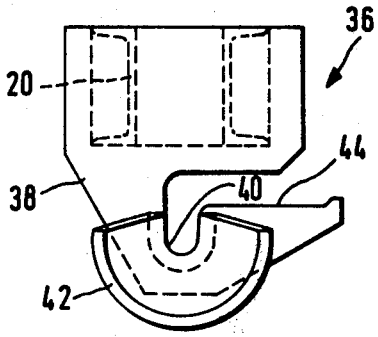
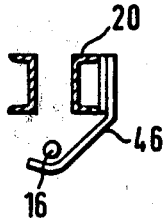
FIG.9

FURNACE TAPHOLE DRILLING APPARATUS AND METHOD

BACKGROUND OF THE INVENTION (1) Field of the Invention

The present invention relates to the field of smelting and particularly to the extraction of molten metal from a shaft furnace. More specifically, this invention is directed to improvements in apparatus for opening the tapholes which are provided at the base of the wall of a smelting furnace. Accordingly, the general objects of the present invention are to provide novel and improved methods and apparatus of such character.

(2) Description of the Prior Art

The molten metal produced during a smelting process in a shaft furnace is extracted from the furnace through tapholes which are provided at the base of the furnace wall. In the prior art these tapholes have, as necessary, been opened by means of a drilling process and plugged by means of the injection therein of a material which solidifies to define a very hard resistant stopper in the taphole. The plugging is performed by apparatus known in the art as "clay guns" and it is the hardened "clay" which has been removed, to open the taphole, with a percussive drill. These drilling and plugging operations are typically repeated several times a day and, in the case of large capacity furnaces, at several points about the furnace. For further information with regard to prior art "clay guns" and taphole driling devices, reference may be had to U.S. Pat. Nos. 3,765,663; 4,058,300; 4,063,772; 4,097,033; 4,195,825; 4,201,373 and 4,227,682, all of which are assigned to the assignee of the present invention.

A recent innovation in the plugging and drilling of furnace tapholes comprises the insertion of a metal drill rod in the plugging material whereby, upon hardening of the plugging material, the rod will form an integral part of the taphole stopper. The rod, which passes through the plugging material from the exterior of the furnace to the interior, is left in position. When the taphole has to be reopened, the metal drill rod is engaged by a percussion type instrument which loosens the rod and permits its extraction. This technique of opening a shaft furnace taphole has a number of advantages. Firstly, the drill rod may be reused and, by way of contrast with the drill bits previously employed to drill out the plugging material, the drill rod need not be fabricated from an expensive special steel. Additionally, the withdrawal of a metal drill rod which has been left in place in the taphole plug results in the formation of an opening which has a greater length to diameter ratio than those formed by the prior drilling processes. This is considered a significant advantage since the small diameter opening is more suitable for high pressure furnaces and prolongs the period during which the molten metal is withdrawn from the furnace thereby facilitating the handling of this molten metal.

In order to extract a drill rod from hardened plugging material, it is possible to employ conventional percussive type drilling devices provided that they are capable of producing both longitudinal vibratory motion in both directions. However, the prior art drills must be provided with a device which will engage, preferably automatically, the drill rod so that the motion generated by the tool may be imparted thereto. If the coupling of the percussive instrument to the end of the drill rod which extends from the taphole plug can be rapidly and automatically accomplished, a taphole may theoretically be opened within one minute after a decision to open the hole has been made. This is a very significant savings in time when compared to the prior art tapping operations wherein a plug was drilled from the taphole.

Unfortunately, the theoretically possible savings in time in opening a furnace taphole discussed above have not been realized because the engagement of a conventional percussive drill with a drill rod has proven to be a time consuming task. It is customary for a percussion-type taphole drill to be mounted on and movable along a support bar. This support bar must be provided with a guide and support device at the end thereof which approaches closest to the furnace wall in order to provide the necessary support for the drill rod before or after it is supported in the taphole. The end of the taphole drill support bar, when being moved from the inoperative or rest position into its working position in alignment with the taphole, performs what may generally be described as a double movement. The last stage of this movement is in the vertical direction, i.e., in a direction parallel to the wall of the furnace, while the initial phase of movement is either along a horizontal or inclined approach trajectory. Because of this final vertical phase of movement, however, a guide plate which defines a drill rod receiving channel at the end of the drill support bar cannot be caused to engage the end of the drill rod which extends outwardly from the taphole. Thus, it has previously been necessary to perform the time-consuming task of dismantling the support plate from the drill support bar, engaging the plate with the drill rod supported in the taphole plugging material, causing the drill to engage the rod and then reattaching the support plate to the drill support bar. In addition to being a time consuming task, this work must be performed adjacent the furnace wall where there is the ever present danger of injury.

It is to be observed that a recently introduced drill support mechanism, as depicted in aforementioned U.S. Pat. No. 4,201,373, eliminates the necessity of utilizing two different phases of motion to move a percussive drill from the inoperative to the operative position. Thus, the apparatus of U.S. Pat. No. 4,201,373 enables the movement of the end of the drill support bar along a continuous trajectory which includes an approach component and a final positioning component which is relatively small and comprises the descent of the drill into the operative position. This compound movement places the drill support bar practically in alignment with a continuation of the axis of the taphole, and thus also in alignment with the drill rod, as the guide plate at the end of the support bar approaches the end of the drill rod. Nevertheless, even when employing the drill support mechanism of U.S. Pat. No. 4,201,373, there is a problem in insuring that the exposed end of the drill rod will be guided into the rod receiving channel in the support plate at the end of the support bar.

SUMMARY OF THE INVENTION

The present invention overcomes the above-discussed and other deficiencies and disadvantages of the prior art by providing a novel and improved support device suitable for affixation to the end of a movable support bar along which a percussive taphole drill moves. In accordance with a preferred embodiment, this support mechanism comprises a support plate and, integral therewith, a generally funnel-shaped guide mechanism which extends through the support plate. This guide mechanism will have a cylindrical portion which penetrates the support plate and a frustoconical portion which extends outwardly from the cylindrical portion and faces away from the drill.

In one embodiment the generally funnel-shaped portion of the guide member presents continuous surfaces. In accordance with a second embodiment, the surface of the guide member is discontinuous, with the cylindrical portion thereof defining an open-topped groove, whereby a drill rod may be inserted from the side.

Also in accordance with the invention, the cylindrical portion of the guide member may include a divergent section at the end which faces the drill.

The present invention also contemplates drilling apparatus which comprises a tool mounted for movement along an elongated support bar, the tool including means for gripping a drill rod, the drilling apparatus including a guide and support mechanism affixed to the forward end of the support bar in such a manner that the tool and a drill rod supported on the guide and support device are coaxial.

It is also within the contemplation of the present invention to provide an additional support, in the form of a generally hook-shaped member, intermediate a movable tool supported on a support bar and a guide and support member which is affixed to the forward end of the support bar.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which:

FIG. 5 is a side-elevational view, partly in section, of a preferred embodiment of a guide and support head in accordance with the present invention;

FIG. 6 is a front plan view of the apparatus of FIG. 5;

FIG. 7 is a side elevation view, partly in section, of a guide and support head in accordance with a second embodiment of the present invention;

FIG. 8 is a front-plan view of the apparatus of FIG. 7; and

FIG. 9 is a schematic front plan view of a supplemental support hook for use in the practice of the present invention, the hook of FIG. 9 also being shown schematically in FIG. 4.

DESCRIPTION OF THE PREFERRED EMBODIMENT

Figure 1:
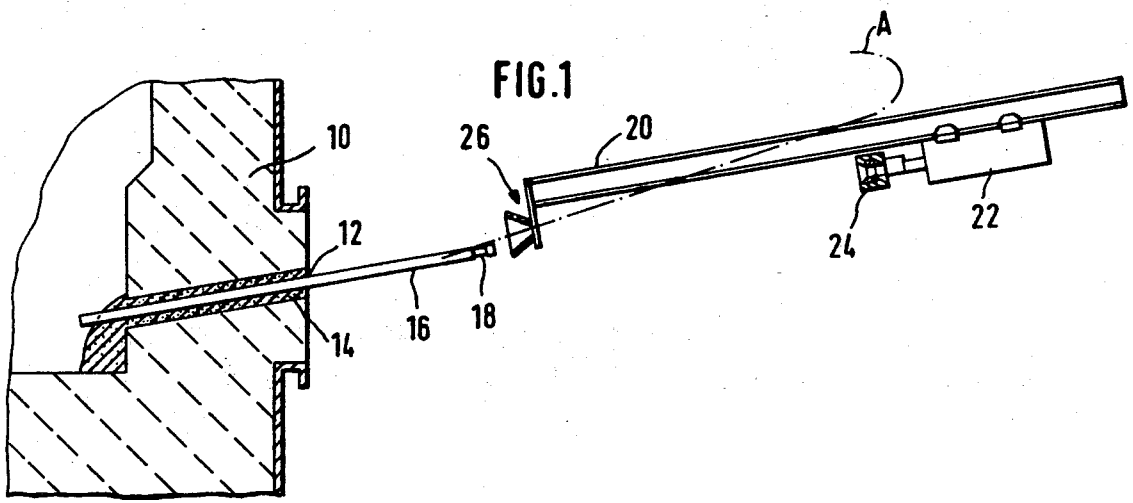
FIG. 1 is a schematic, side-elevation view of a taphole drill employing a guide and support head in accordance with a first embodiment of the present invention, the drill and its support bar being shown in a first position.

Referring now simultaneously to FIGS. 1–4, the base of the wall of a shaft furnace is indicated at 10. Furnace wall 10 is provided with a plurality of tapholes, such as taphole 12, which are plugged with a "clay", the hardened clay being indicated at 14. During the plugging process a drill rod 16 was inserted through the "clay" before it had set and, accordingly, the drill rod 16 forms part of the plug in taphole 12. The next taphole opening operation will, accordingly, consist of withdrawing the drill rod 16 from the hardened clay 14 in order to open a passage through the taphole 12. The drill rod 16 is provided, at its outermost end, with a circular groove 18 which may be gripped by the tool employed to free rod 16 from clay 14.

In order to extract rod 16, a percussive tool having the capability of producing longitudinal vibratory motion in both directions will be employed. Such a percussion tool, indicated at 22, is mounted on a support bar 20. The tool is capable of movement along bar 20 and, as indicated by broken line A in FIG. 1, the bar itself is movable by virtue of its use of support structures such as that shown in aforementioned U.S. Pat. No. 4,201,373. The percussive tool is provided with a gripping or coupling device 24 designed to engage the groove 18 in the end of drill bar 16.

As the support bar 20 moves between its retracted and operating positions it follows a slanting trajectory in which, as the end of the support bar approaches the wall of the furnace, it descends in the direction of the tap spout, not shown in the drawing, which is aligned with the taphole. This trajectory is continuous in that it does not include a phase in which the support bar moves only in the vertical direction. The necessity of imparting vertical motion to the support bar when the end thereof is adjacent the furnace wall would, as discussed above, render it impossible to engage the drill bar 16 with a guide and support head 26. This guide and support head 26, which is affixed to the end of the support bar 20, is essential in order to properly support the drill rod during the extraction thereof from the taphole, particularly when the extraction process has proceeded to the point represented in FIG. 4.

There will necessarily be some slight misalignment at the point along the trajectory of the support bar where the head 26, while contacting the drill rod 16, has not yet moved to its point of closest proximity to the furnace wall. Accordingly, the present invention employs a guide and support head 26 which has a portion at its forward end which diverges in the direction of the drill rod. The establishment of contact between this divergent portion of the head 26 and the end of the drill rod will result in a minimal forced variation in the trajectory in the end of the support bar and/or a flexing of the drill rod during which the end of rod 16 will be guided, by the divergent portion of the head, through a central aperture in head 26. This central aperture will be coaxial with the gripping device 24 of the tool 22.

FIG. 1 illustrates the appproach phase of support bar 20 to the end of drill rod 16. The movement of the head 26 in the direction shown by trajectory A will automatically, as discussed above, guide the end of rod 16 through the central aperture of head 26. The operative position of the tool, i.e., the closest approach of the head 26 to the furnace wall 10, is indicated in FIG. 2.

Figure 2:
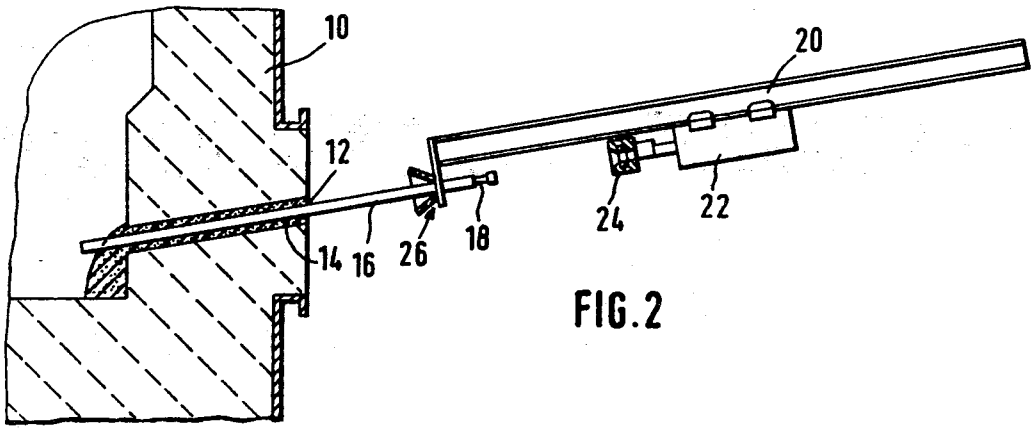
FIG. 2 is a view similar to FIG. 1 showing the drill, support bar and guide and support head in a second position.
Figure 3:
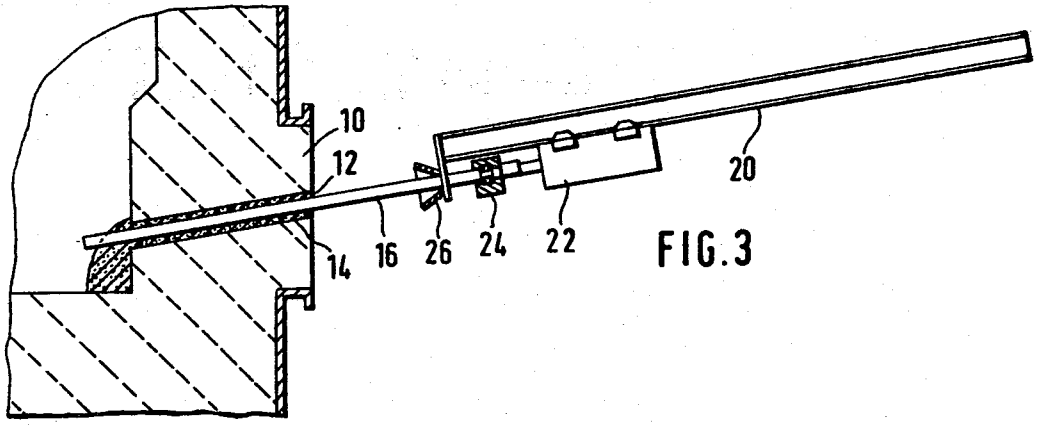
FIG. 3 is a view similar to FIG. 2 showing the drill in a third position.

When the support bar reaches the position indicated in FIG. 2, the tool 22 will be caused to move forwardly along support bar 20 in order to cause the gripping device 24 to engage the end of the drill rod 16 as depicted in FIG. 3. In order to facilitate the operation of the apparatus, and particularly to insure that the edges of the groove 18 in drill rod 16 do not "hang-up" on the edges of the head 26, it is desirable to include a region, at the trailing end of head 26, which diverges slightly in a direction opposite to the forward portion of the head. Similarly, it is also desirable to provide the gripping device 24 with a divergent entrance aperture to facilitate engagement of the gripping device with the drill rod. The means by which a firm connection is established between gripping device 24 and drill rod 16 is known in the art, does not comprise part of the present invention and thus will not be described herein. However, it should be noted that the gripping device may be pneumatically operated from the same fluid source which powers the tool 22.

Figure 4:
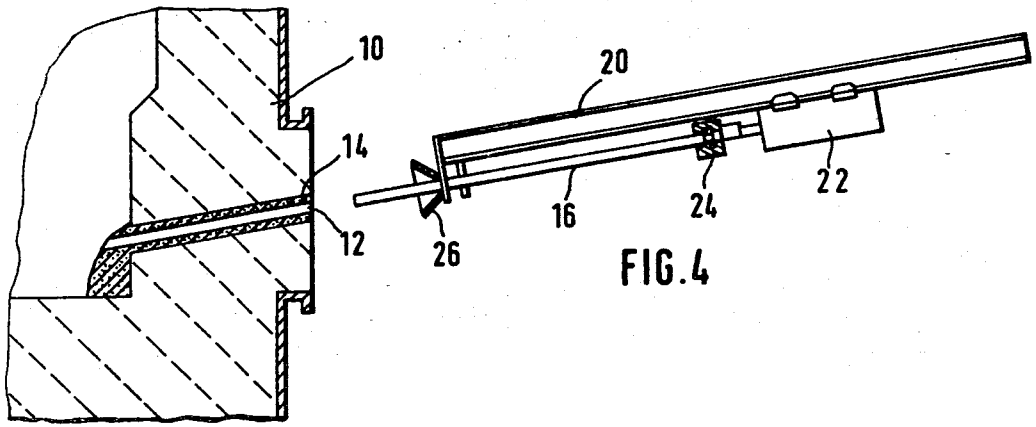
FIG. 4 is a view similar to FIGS. 2 and 3 showing the drill in a fourth position.

When the gripping device 24 has engaged the end of rod 16, the percussion tool will be actuated in order to free rod 16 from clay 14 and, subsequently, to extract the drill rod from the taphole by causing the tool 22 to move outwardly along bar 20 as illustrated in FIG. 4. When the drill rod has been completely disengaged from the taphole 12 it will, as shown in FIG. 4 be supported at one end from the head 26 and at the other end by the tool and particularly its gripping device 24.

FIGS. 5 and 6 shown details of a guide and support head 26 in accordance with a first embodiment of the present invention. The head 26 comprises a plate 34 which is rigidly attached, for example by the use of bolts, to the front end of the movable support bar 20. The plate 34 descends downwardly from bar 20 and, at a point beneath bar 20, is provide with an aperture. A cylindrial member 28 is welded into this aperture and extends to either side of plate 34 as shown. A frustoconical shaped extension 30 projects from cylindrical member 28. The members 28 and 30 are continuous, i.e., define a funnel-shaped guide structure, wherein the end of the drill rod will be guided along the inner wall of the frustoconical portion 30 into the cylindrical portion 28. As noted above, it is desirable to provide a divergent trailing edge, as indicated at 32, on the cylindrical portion 28.

The embodiment of the invention depicted in FIGS. 5 and 6 will preferably be used in cooperation with a supporting hook 46 of the type shown in FIG. 9. The supporting hook 46 will be affixed to the support bat 20, as indicated in FIG. 4, a short distance behind the guide and support head 26. The arrangement of FIG. 4 thus permits the withdrawal of the drill rod until it clears the support head 26. At that point the drill rod may be removed by releasing the gripping device and lifting the rod off the hook 46.

A second embodiment of a guide and support head, the head being indicated generally at 36, is shown in FIGS. 7 and 8. In the embodiment of FIGS. 7 and 8 the frustoconical portion 30 and the cylindrical portion 38 of the head are discontinuous. Thus, the frustoconical portion indicated at 42, is of generally semi-circular shape while the cylindrical portion, indicated at 40 in FIGS. 7 and 8, is provided with an opening in its top which is sufficiently large to permit the insertion of a drill rod. The plate, indicated at 38 in FIGS. 7 and 8, is provided with a lateral groove 44 which merges with the open-topped cylindrical portion 40 as best seen in FIG. 8. Accordingly, a drill rod supported in the head of FIGS. 7 and 8 may be raised slightly out of the cylindrical portion 40 and then moved laterally along slot 44. Use of the head of FIGS. 7 and 8 obviates the necessity of withdrawing the drill rod completely from the guide and support head and thus further protects against the possibility that the entire weight of the rod will be imposed on the gripping device 24 during the extraction process.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A support device affixed to the leading end of a movable support bar along which a percussive taphole drill moves, said support device locating the end of a drill rod which is inserted through a hardened clay plug of a taphole and positioning the end of the drill rod so that it can be received and gripped by a coupling device of the percussive taphole drill, said support device comprising:

guide member means, said guide member means having an alignment portion which is dimensioned so as to allow passage of said drill rod therethrough, said alignment portion aligning the end of said drill rod with the coupling device of said percussive taphole drill, said guide member means further including a locating and adjusting portion, said locating and adjusting portion engaging the end of said drill rod and guiding it to said alignment portion;

said locating and adjusting portion being a partial hollow frustoconical shaped member having its narrow end justapositioned and aligned with said alignment means, said frustoconical shaped member further being provided with an open lateral groove extending out from said alignment portion; and means for mounting sid guide member to the leading end of the movable support bar.

2. The support device of claim 1 wherein said locating and adjusting portion is a hollow frustoconical shaped member having its narrow end juxtapositioned and aligned with said alignment means.

3. The support device of claim 2 wherein said shaped member extends 180° about the bottom of said alignment portion.

4. The support device of claim 2 wherein said alignment means is a cylindrical member aligned with and extending from said locating and adjusting means narrow end.

5. The support device of claim 4 wherein said alignment means diverges outward opposite said locating and adjusting means.

6. The support device of claim 1 wherein said mounting means comprises a plate which is affixed to the leading end of the movable support bar and to which said guide member is mounted.

* * * * *